US008471786B2

(12) United States Patent
Origuchi et al.

(10) Patent No.: US 8,471,786 B2
(45) Date of Patent: Jun. 25, 2013

(54) PLASMA DISPLAY DEVICE AND PLASMA DISPLAY PANEL DRIVING METHOD

(75) Inventors: Takahiko Origuchi, Osaka (JP); Mitsuo Ueda, Hyogo (JP)

(73) Assignee: Panasonic Corporation, Osaka (JP)

( * ) Notice: Subject to any disclaimer, the term of this patent is extended or adjusted under 35 U.S.C. 154(b) by 217 days.

(21) Appl. No.: 13/127,576

(22) PCT Filed: Nov. 12, 2009

(86) PCT No.: PCT/JP2009/006036

§ 371 (c)(1),
(2), (4) Date: May 4, 2011

(87) PCT Pub. No.: WO2010/055661

PCT Pub. Date: May 20, 2010

(65) Prior Publication Data

US 2011/0210991 A1 Sep. 1, 2011

(30) Foreign Application Priority Data

Nov. 13, 2008 (JP) ..... 2008-290541

(51) Int. Cl.
*G09G 3/28* (2006.01)
*G09G 5/10* (2006.01)

(52) U.S. Cl.
USPC ..... 345/63; 345/690; 345/60

(58) Field of Classification Search
USPC ..... 345/690, 60–72
See application file for complete search history.

(56) References Cited

U.S. PATENT DOCUMENTS

| | | | | |
|---|---|---|---|---|
| 7,091,934 | B2 * | 8/2006 | Kim et al. | 345/60 |
| 2004/0257310 | A1 * | 12/2004 | Yu et al. | 345/63 |
| 2005/0068265 | A1 * | 3/2005 | Joo et al. | 345/60 |
| 2005/0200571 | A1 * | 9/2005 | Gotoda et al. | 345/63 |
| 2005/0248594 | A1 * | 11/2005 | Usui et al. | 345/690 |
| 2006/0132659 | A1 | 6/2006 | Kimura et al. | |
| 2011/0210992 | A1 * | 9/2011 | Saito et al. | 345/690 |
| 2011/0216108 | A1 * | 9/2011 | Origuchi et al. | 345/690 |

FOREIGN PATENT DOCUMENTS

| | | | |
|---|---|---|---|
| JP | 2005-208369 | A | 8/2005 |
| JP | 2005-208369 | A | 8/2005 |
| JP | 2005-257754 | A | 9/2005 |

(Continued)

OTHER PUBLICATIONS

Japanese Office Action for 2010-513537 dated Oct. 23, 2012.
International Search Report for Application No. PCT/JP2009/006036, Feb. 16, 2010, Panasonic Corporation.

*Primary Examiner* — Dorothy Harris
(74) *Attorney, Agent, or Firm* — RatnerPrestia

(57) ABSTRACT

Display luminance is uniformized and the brightness is enhanced. A plasma display device has image signal processing circuit including loading correction part. The loading correction part has: number of lit cells calculator for calculating the number of discharge cells to be lit in each display electrode pair, in each subfield; load value calculator for calculating a load value of each discharge cell, according to the calculation result in number of lit cells calculator; correction gain calculator for calculating a correction gain of each discharge cell, according to the position of the discharge cell and the calculation result in load value calculator, such that the correction gain is smaller in the central portion than in the peripheral portion on the plasma display panel's image display surface; and corrector for subtracting the multiplication result of the output from correction gain calculator and an input image signal, from the input image signal.

2 Claims, 13 Drawing Sheets

FOREIGN PATENT DOCUMENTS

| | | | |
|---|---|---|---|
| JP | 2005-315956 | A | 11/2005 |
| JP | 2006-184843 | A | 7/2006 |
| JP | 2006-301555 | A | 11/2006 |
| JP | 2006-301555 | A | 11/2006 |
| JP | 2006-301556 | A | 11/2006 |
| JP | 2006-301556 | A | 11/2006 |
| JP | 2006-337720 | A | 12/2006 |
| JP | 2006-337720 | A | 12/2006 |
| JP | 2008-145880 | A | 6/2008 |
| JP | 2008-145880 | A | 6/2008 |

* cited by examiner

121

| | | | | | | | | | | | | | | | |
|---|---|---|---|---|---|---|---|---|---|---|---|---|---|---|---|
| First SF | 1 | 1 | 1 | 1 | 1 | 1 | 1 | 1 | 1 | 1 | 1 | 1 | 1 | 1 | 1 |
| Second SF | 1 | 1 | 1 | 1 | 1 | 1 | 1 | 1 | 1 | 1 | 1 | 1 | 1 | 1 | 1 |
| Third SF | 1 | 1 | 1 | 1 | 1 | 1 | 1 | 1 | 1 | 1 | 1 | 1 | 1 | 1 | 1 |
| Fourth SF | 1 | 1 | 1 | 1 | 1 | | | | | | 1 | 1 | 1 | 1 | 1 |
| Fifth SF | 1 | 1 | 1 | 1 | 1 | | | | | | 1 | 1 | 1 | 1 | 1 |
| Sixth SF | 1 | 1 | 1 | 1 | 1 | | | | | | 1 | 1 | 1 | 1 | 1 |
| Seventh SF | | | | | | | | | | | | | | | |
| Eighth SF | | | | | | | | | | | | | | | |

122

| | Number of lit cells | Luminance weight | Lighting state of discharge cell B | Calculated value |
|---|---|---|---|---|
| First SF | 15 | 1 | 1 | 15 |
| Second SF | 15 | 2 | 1 | 30 |
| Third SF | 15 | 4 | 1 | 60 |
| Fourth SF | 10 | 8 | 1 | 80 |
| Fifth SF | 10 | 16 | 1 | 160 |
| Sixth SF | 10 | 32 | 1 | 320 |
| Seventh SF | 0 | 64 | 0 | 0 |
| Eighth SF | 0 | 128 | 0 | 0 |

| | |
|---|---|
| Total sum of calculated values | 665 |

131

| | | | | | | | | | | | | | | | |
|---|---|---|---|---|---|---|---|---|---|---|---|---|---|---|---|
| First SF | 1 | 1 | 1 | 1 | 1 | 1 | 1 | 1 | 1 | 1 | 1 | 1 | 1 | 1 | 1 |
| Second SF | 1 | 1 | 1 | 1 | 1 | 1 | 1 | 1 | 1 | 1 | 1 | 1 | 1 | 1 | 1 |
| Third SF | 1 | 1 | 1 | 1 | 1 | 1 | 1 | 1 | 1 | 1 | 1 | 1 | 1 | 1 | 1 |
| Fourth SF | 1 | 1 | 1 | 1 | 1 | 1 | 1 | 1 | 1 | 1 | 1 | 1 | 1 | 1 | 1 |
| Fifth SF | 1 | 1 | 1 | 1 | 1 | 1 | 1 | 1 | 1 | 1 | 1 | 1 | 1 | 1 | 1 |
| Sixth SF | 1 | 1 | 1 | 1 | 1 | 1 | 1 | 1 | 1 | 1 | 1 | 1 | 1 | 1 | 1 |
| Seventh SF | | | | | | | | | | | | | | | |
| Eighth SF | | | | | | | | | | | | | | | |

132

| | Number of lit cells | Luminance weight | Lighting state of discharge cell B | Calculated value |
|---|---|---|---|---|
| First SF | 15 | 1 | 1 | 15 |
| Second SF | 15 | 2 | 1 | 30 |
| Third SF | 15 | 4 | 1 | 60 |
| Fourth SF | 15 | 8 | 1 | 120 |
| Fifth SF | 15 | 16 | 1 | 240 |
| Sixth SF | 15 | 32 | 1 | 480 |
| Seventh SF | 0 | 64 | 0 | 0 |
| Eighth SF | 0 | 128 | 0 | 0 |
| | | Total sum of calculated values | | 945 |

PLASMA DISPLAY DEVICE AND PLASMA DISPLAY PANEL DRIVING METHOD

THIS APPLICATION IS A U.S. NATIONAL PHASE APPLICATION OF PCT INTERNATIONAL APPLICATION PCT/JP2009/006036.

TECHNICAL FIELD

The present invention relates to a plasma display device for use in a wall-mounted television or a large monitor, and to a driving method for a plasma display panel.

BACKGROUND ART

A typical alternating-current surface discharge panel used as a plasma display panel (hereinafter, simply referred to as "panel") has a large number of discharge cells that are formed between a front plate and a rear plate facing each other. The front plate has the following elements:

- a plurality of display electrode pairs, each formed of a scan electrode and a sustain electrode, disposed on a front glass substrate parallel to each other; and
- a dielectric layer and a protective layer formed so as to cover the display electrode pairs. The rear plate has the following elements:
- a plurality of parallel data electrodes formed on a rear glass substrate;
- a dielectric layer formed so as to cover the data electrodes;
- a plurality of barrier ribs formed on the dielectric layer parallel to the data electrodes; and
- phosphor layers formed on the surface of the dielectric layer and on the side faces of the barrier ribs.

The front plate and the rear plate face each other such that the display electrode pairs and the data electrodes three-dimensionally intersect, and are sealed together. A discharge gas containing xenon in a partial pressure ratio of 5%, for example, is sealed into the inside discharge space. Discharge cells are formed in portions where the display electrode pairs face the data electrodes. In a panel having such a structure, gas discharge generates ultraviolet light in each discharge cell. This ultraviolet light excites the red (R), green (G), and blue (G) phosphors so that the phosphors emit the corresponding colors for color display.

As a driving method for the panel, a subfield method is typically used. In the subfield method, one field period is divided into a plurality of subfields, and gradations are displayed by the combination of the subfields where light is emitted.

Each subfield has an initializing period, an address period, and a sustain period. In the initializing period, an initializing waveform is applied to the respective scan electrodes so as to cause an initializing discharge in the respective discharge cells. This initializing discharge forms wall charge necessary for the subsequent address operation in the respective discharge cells and generates priming particles (excitation particles for causing an address discharge) for stably causing the address discharge.

In the address period, a scan pulse is sequentially applied to the scan electrodes (hereinafter, this operation being also referred to as "scanning"). Further, an address pulse corresponding to a signal of an image to be displayed is selectively applied to the data electrodes (hereinafter, these operations being also generically referred to as "addressing"). Thus, an address discharge is selectively caused between the scan electrodes and the data electrodes so as to selectively form wall charge.

In the sustain period, a sustain pulse is alternately applied to display electrode pairs, each formed of a scan electrode and a sustain electrode, at a predetermined number of times corresponding to a luminance to be displayed. Thereby, a sustain discharge is selectively caused in the discharge cells where the address discharge has formed wall charge, and thus causes light emission in the discharge cells (hereinafter, causing light emission in a discharge cell being also referred to as "lighting", causing no light emission in a discharge cell as "non-lighting"). In this manner, an image is displayed in the display area of the panel.

In this subfield method, the following operations, for example, can minimize the light emission unrelated to gradation display and thus improve the contrast ratio. In the initializing period of one subfield among a plurality of subfields, an all-cell initializing operation for causing a discharge in all the discharge cells is performed. In the initializing periods of the other subfields, a selective initializing operation for causing an initializing discharge selectively in the discharge cells having undergone a sustain discharge is performed.

With a recent increase in the screen size and definition of a panel, the plasma display device is requested to have enhanced image display quality. However, a difference in drive impedance between display electrode pairs causes a difference in the voltage drop in drive voltage. This can produce a difference in emission luminance, even with image signals having an equal luminance, in some cases.

To address this problem, the following technique is disclosed (see Patent Literature 1, for example). In this technique, the lighting patterns in the subfields in one field are changed when the drive impedance changes between display electrode pairs.

The important factors in determining an image display quality include the brightness of a display image. The brightness of a display image is one of the important factors in determining the image display quality. Depending on the viewing environment of the plasma display device, a decrease in the luminance of a display image can be recognized as a deterioration of the image display quality in some cases.

In a generally-viewed dynamic image, e.g. a television broadcast, a steadily gazed portion, e.g. a human face, is relatively frequently positioned in the vicinity of the center of the image display surface (hereinafter, also simply referred to as "display surface") of a panel. For this reason, the brightness of the central portion of the display surface is likely to be recognized as the brightness of the display image. Thus, when the central portion of the display surface has a low luminance, the user may have an impression that the display image is dark.

However, with the technique disclosed in Patent Literature 1, it is difficult to control the luminance of the discharge cells according to the positions on the display surface.

CITATION LIST

Patent Literature

[PTL1]
Japanese Patent Unexamined Publication No. 2006-184843

SUMMARY OF THE INVENTION

A plasma display device includes the following elements:

a panel, the panel being driven by a subfield method in which a plurality of subfields are set in one field, each of the subfields has an initializing period, an address period, and a sustain period, a luminance weight is set for each of the subfields, and sustain pulses corresponding in number to the luminance weight are generated in the sustain period for gradation display, the panel having a plurality of discharge cells, the discharge cells having display electrode pairs, each of the display electrode pairs being formed of a scan electrode and a sustain electrode; and an image signal processing circuit for converting an input image signal into image data showing light emission and no light emission in the discharge cells in each subfield, the image signal processing circuit having the following elements:

a number of lit cells calculator for calculating the number of discharge cells to be lit in each display electrode pair, in each subfield;

a load value calculator for calculating a load value of each of the discharge cells, according to the calculation result in the number of lit cells calculator;

a correction gain calculator for calculating a correction gain of each of the discharge cells, according to the position of the discharge cell and the calculation result in the load value calculator such that the correction gain is smaller in the central portion than in the peripheral portion of the image display surface of the panel; and a corrector for subtracting the multiplication result of the output from the correction gain calculator and the input image signal, from the input image signal.

With this structure, according to the position of the discharge cell, the correction gain can be produced for loading correction so as to be smaller in the central portion than in the peripheral portion of the display surface. Thus, this structure can uniformize the display luminance and improve the brightness of the display image, and thereby enhance the image display quality.

DETAILED DESCRIPTION OF PREFERRED EMBODIMENTS

Hereinafter, a plasma display device in accordance with an exemplary embodiment of the present invention will be described, with reference to the accompanying drawings.

Exemplary Embodiment

Figure 1:
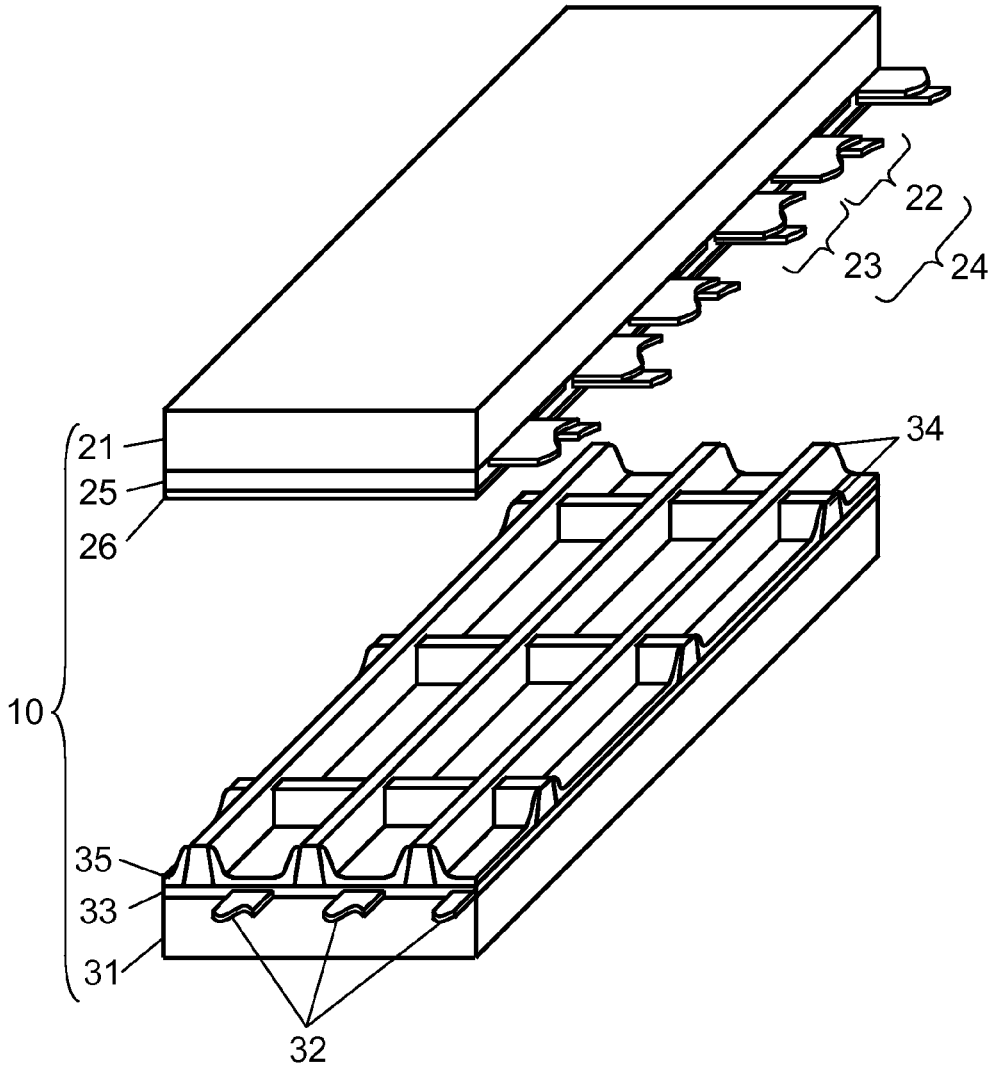
FIG. 1 is an exploded perspective view showing a structure of a panel in accordance with an exemplary embodiment of the present invention.

FIG. 1 is an exploded perspective view showing a structure of panel 10 in accordance with the exemplary embodiment of the present invention. A plurality of display electrode pairs 24, each formed of scan electrode 22 and sustain electrode 23, is disposed on glass front plate 21. Dielectric layer 25 is formed so as to cover scan electrodes 22 and sustain electrodes 23. Protective layer 26 is formed over dielectric layer 25.

In order to lower breakdown voltage in discharge cells, protective layer 26 is made of a material predominantly composed of MgO because MgO has proven performance as a panel material, and exhibits a large secondary electron emission coefficient and excellent durability when neon (Ne) and xenon (Xe) gas is sealed.

A plurality of data electrodes 32 is formed on rear plate 31. Dielectric layer 33 is formed so as to cover data electrodes 32, and mesh barrier ribs 34 are formed on the dielectric layer. On the side faces of barrier ribs 34 and dielectric layer 33, phosphor layers 35 for emitting light in red (R), green (G), and blue (B) colors are formed.

Front plate 21 and rear plate 31 face each other such that display electrode pairs 24 intersect with data electrodes 32 with a small discharge space sandwiched between the electrodes. The outer peripheries of the plates are sealed with a sealing material, e.g. a glass frit. In the inside discharge space, a mixed gas of neon and xenon is sealed as a discharge gas. In this exemplary embodiment, a discharge gas having a xenon partial pressure of approximately 10% is used to improve the emission efficiency. The discharge space is partitioned into a plurality of compartments by barrier ribs 34. Discharge cells are formed in the intersecting parts of display electrode pairs 24 and data electrodes 32. The discharge cells discharge and emit light (are lit) so as to display an image. In panel 10, three discharge cells for emitting the corresponding R, G, and B light form one pixel.

The structure of panel 10 is not limited to the above, and may include barrier ribs formed in a stripe pattern. The mixing ratio of the discharge gas is not limited to the above numerical value, and other mixing ratios may be used.

Figure 2:
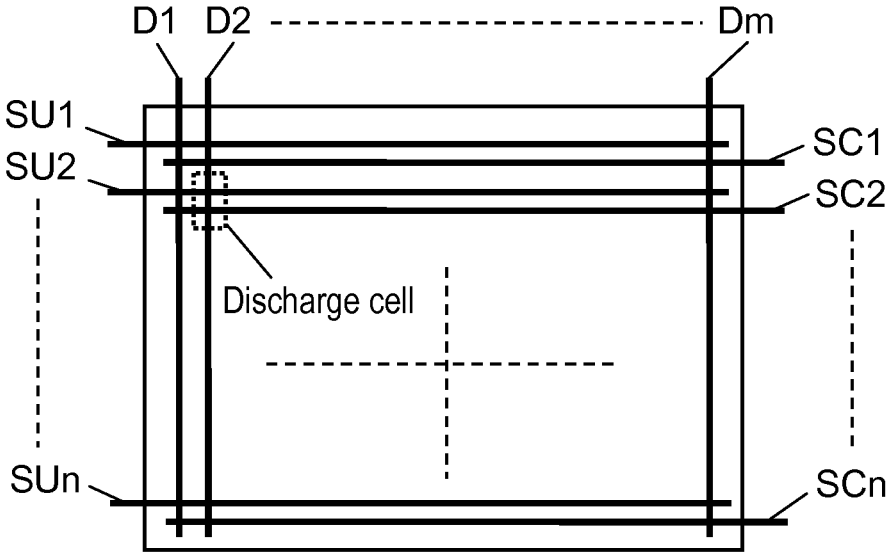
FIG. 2 is an electrode array diagram of the panel.

FIG. 2 is an electrode array diagram of panel 10 in accordance with the exemplary embodiment of the present invention. Panel 10 has n scan electrode SC1 through scan electrode SCn (scan electrodes 22 in FIG. 1) and n sustain electrode SU1 through sustain electrode SUn (sustain electrodes 23 in FIG. 1) both long in the row direction, and m data electrode D1 through data electrode Dm (data electrodes 32 in FIG. 1) long in the column direction. A discharge cell is formed in the part where a pair of scan electrode SCi (i being 1 through n) and sustain electrode SUi intersects with one data electrode Dj (j being 1 through m). Thus, m×n discharge cells are formed in the discharge space. The area where m×n discharge cells are formed is the display area of panel 10.

Next, driving voltage waveforms for driving panel 10 and the operation thereof are outlined. A plasma display device of this exemplary embodiment displays gradations by a subfield method: one field is divided into a plurality of subfields along a temporal axis, a luminance weight is set for each subfield, and light emission or no light emission of each discharge cell is controlled in each subfield.

In this subfield (SF) method, one field is formed of eight subfields (the first SF, and the second SF through the eighth SF), and the respective subfields have luminance weights of 1, 2, 4, 8, 16, 32, 64, and 128, for example. In the initializing period of one subfield among the plurality of subfields, an all-cell initializing operation for causing an initializing discharge in all the discharge cells is performed (hereinafter, a subfield for the all-cell initializing operation being referred to as "all-cell initializing subfield"). In the initializing periods of the other subfields, a selective initializing operation for causing an initializing discharge selectively in the discharge cells having undergone a sustain discharge is performed (hereinafter, a subfield for the selective initializing operation being referred to as "selective initializing subfield"). These operations can minimize the light emission unrelated to gradation display and improve the contrast ratio.

In this exemplary embodiment, in the initializing period of the first SF, the all-cell initializing operation is performed. In the initializing periods of the second SF through the eighth SF, the selective initializing operation is performed. With these operations, the light emission unrelated to image display is only the light emission caused by the discharge in the all-cell initializing operation in the first SF. The luminance of a black level, i.e. the luminance in an area displaying a black picture where no sustain discharge is caused, is determined only by the weak light emission in the all-cell initializing operation. Thus, an image having a high contrast can be displayed. In the sustain period of each subfield, sustain pulses equal in number to the luminance weight of the subfield multiplied by a predetermined proportionality factor are applied to respective display electrode pairs 24. This proportionality factor is a luminance magnification.

However, in this exemplary embodiment, the number of subfields, or the luminance weight of each subfield is not limited to the above values. The subfield structure may be switched according to image signals, for example.

Figure 3:
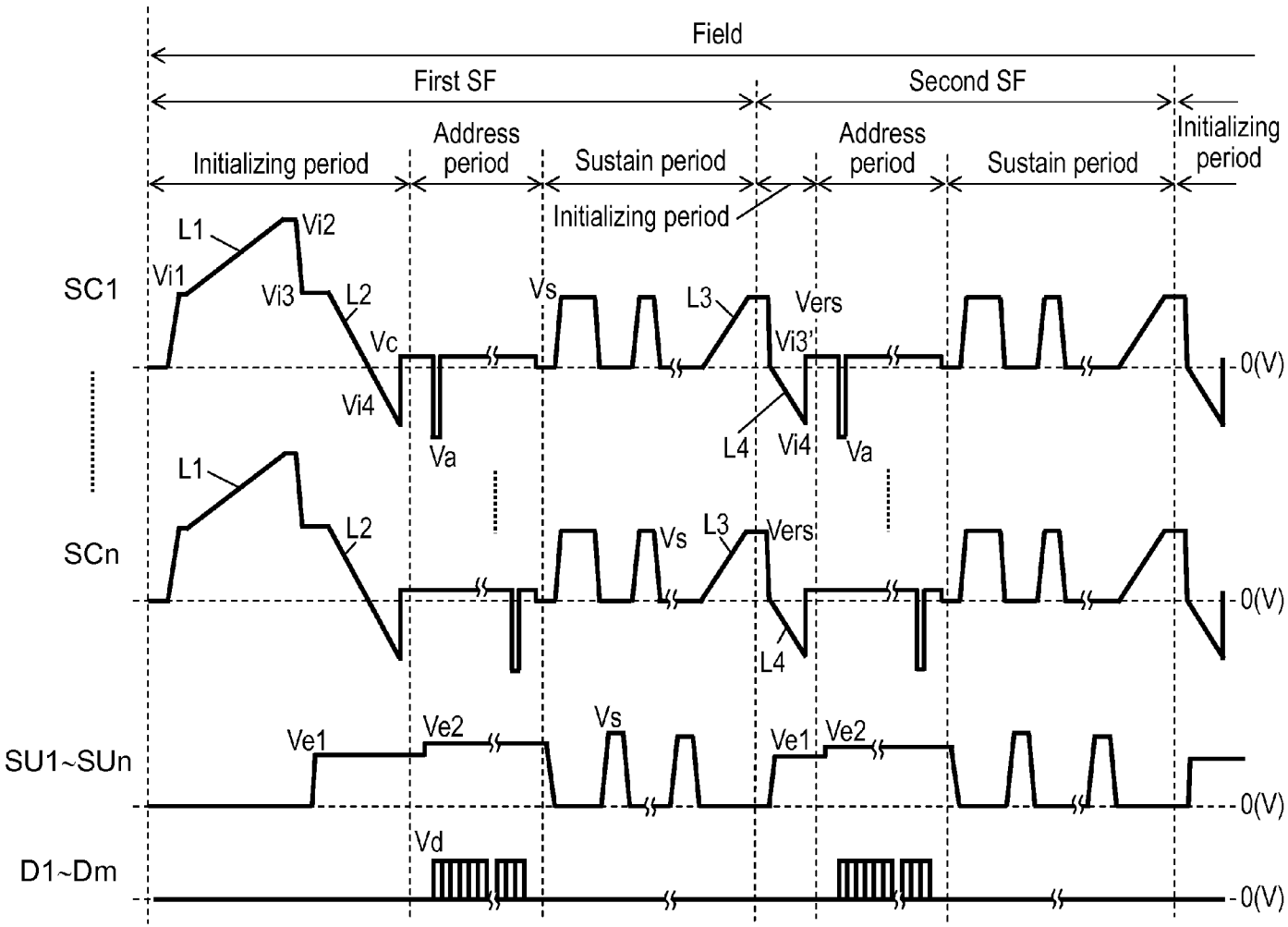
FIG. 3 is a waveform chart of driving voltages applied to the respective electrodes of the panel.

FIG. 3 is a waveform chart of driving voltages applied to the respective electrodes of panel 10 in accordance with the exemplary embodiment of the present invention. FIG. 3 shows driving waveforms applied to scan electrode SC1 to be scanned first in the address periods, scan electrode SCn to be scanned last in the address periods, sustain electrode SU1 through sustain electrode SUn, and data electrode D1 through data electrode Dm.

FIG. 3 shows driving voltage waveforms in two subfields: the first subfield (first SF), i.e. an all-cell initializing subfield; and the second subfield (second SF), i.e. a selective initializing subfield. The driving voltage waveforms in the other subfields are substantially similar to the driving voltage waveforms in the second SF, except for the numbers of sustain pulses generated in the sustain periods. Scan electrode SCi, sustain electrode SUi, and data electrode Dk to be described below show the electrodes selected from the corresponding electrodes, according to image data (data showing light emission or no light emission in each subfield).

First, a description is provided for the first SF, an all-cell initializing subfield. In the first half of the initializing period of the first SF, 0 (V) is applied to each of data electrode D1 through data electrode Dm and sustain electrode SU1 through sustain electrode SUn, and ramp voltage (hereinafter, referred to as "up-ramp voltage") L1 is applied to scan electrode SC1 through scan electrode SCn. Here, the up-ramp voltage gradually (e.g. at a gradient of approximately 1.3 V/μsec) rises from voltage Vi1, which is equal to or lower than a breakdown voltage, toward voltage Vi2, which exceeds the breakdown voltage, with respect to sustain electrode SU1 through sustain electrode SUn.

While up-ramp voltage L1 is rising, a weak initializing discharge continuously occurs between scan electrode SC1 through scan electrode SCn and sustain electrode SU1 through sustain electrode SUn, and between scan electrode SC1 through scan electrode SCn and data electrode D1 through data electrode Dm. Then, negative wall voltage accumulates on scan electrode SC1 through scan electrode SCn; positive wall voltage accumulates on data electrode D1 through data electrode Dm and sustain electrode SU1 through sustain electrode SUn. Here, this wall voltage on the electrodes means the voltage generated by the wall charge that is accumulated on the dielectric layers covering the electrodes, the protective layer, the phosphor layers, or the like.

In the second half of the initializing period, positive voltage Ve1 is applied to sustain electrode SU1 through sustain electrode SUn, 0 (V) is applied to data electrode D1 through data electrode Dm, and ramp voltage (hereinafter, referred to as "down-ramp voltage") L2 is applied to scan electrode SC1 through scan electrode SCn. Here, the down-ramp voltage gradually falls from voltage Vi3, which is equal to or lower than the breakdown voltage, toward voltage Vi4, which exceeds the breakdown voltage, with respect to sustain electrode SU1 through sustain electrode SUn.

During this application, a weak initializing discharge occurs between scan electrode SC1 through scan electrode SCn and sustain electrode SU1 through sustain electrode SUn, and between scan electrode SC1 through scan electrode SCn and data electrode D1 through data electrode Dm. This weak discharge reduces the negative wall voltage on scan electrode SC1 through scan electrode SCn, and the positive wall voltage on sustain electrode SU1 through sustain electrode SUn, and adjusts the positive wall voltage on data electrode D1 through data electrode Dm to a value appropriate for the address operation. In this manner, the all-cell initializing operation for causing an initializing discharge in all the discharge cells is completed.

As shown in the initializing period of the second SF in FIG. 3, driving voltage waveforms where the first half of the initializing period is omitted may be applied to the respective electrodes. That is, voltage Ve1 is applied to sustain electrode SU1 through sustain electrode SUn, 0 (V) is applied to data electrode D1 through data electrode Dm, and down-ramp voltage L4 is applied to scan electrode SC1 through scan electrode SCn. Here, down-ramp voltage L4 gradually falls from a voltage equal to or lower than the breakdown voltage (e.g. a ground potential) toward voltage Vi4. This application causes a weak initializing discharge in the discharge cells having undergone a sustain discharge in the sustain period of the immediately preceding subfield (the first SF in FIG. 3), and reduces the wall voltage on scan electrode SCi and sustain electrode SUi. The excess part of the wall voltage on data electrode Dk (k being 1 through m) is discharged, and the wall voltage is adjusted to a value appropriate for the address operation.

On the other hand, in the discharge cells having undergone no sustain discharge in the immediately preceding subfield, no discharge occurs and the wall charge at the completion of the initializing period of the immediately preceding subfield is maintained. In this manner, the initializing operation where the first half is omitted is a selective initializing operation for causing an initializing discharge in the discharge cells having undergone a sustain operation in the sustain period of the immediately preceding subfield.

In the subsequent address period, scan pulse voltage Va is sequentially applied to scan electrode SC1 through scan electrode SCn. Positive address pulse voltage Vd is applied to data electrode Dk (k being 1 through m) corresponding to a discharge cell to be lit among data electrode D1 through data electrode Dm. Thus, an address discharge is caused selectively in the corresponding discharge cells.

In the address period, first, voltage Ve2 is applied to sustain electrode SU1 through sustain electrode SUn, and voltage Vc is applied to scan electrode SC1 through scan electrode SCn.

Next, negative scan pulse voltage Va is applied to scan electrode SC1 in the first row, and positive address pulse voltage Vd is applied to data electrode Dk (k being 1 through m) of the discharge cell to be lit in the first row among data electrode D1 through data electrode Dm. At this time, the voltage difference in the intersecting part of data electrode Dk and scan electrode SC1 is obtained by adding the difference between the wall voltage on data electrode Dk and the wall voltage on scan electrode SC1 to a difference in externally applied voltage (voltage Vd-voltage Va), and thus exceeds the breakdown voltage.

Then, a discharge occurs between data electrodes Dk and scan electrode SC1. Since voltage Ve2 is applied to sustain electrode SU1 through sustain electrode SUn, the voltage difference between sustain electrode SU1 and scan electrode SC1 is obtained by adding the difference between the wall voltage on sustain electrode SU1 and the wall voltage on scan electrode SC1 to a difference in externally applied voltage (voltage Ve2-voltage Va). At this time, setting voltage Ve2 to a value slightly lower than the breakdown voltage can make a state where a discharge is likely to occur but not actually occurs between sustain electrode SU1 and scan electrode SC1.

With this setting, the discharge caused between data electrode Dk and scan electrode SC1 can trigger a discharge between the areas of sustain electrode SU1 and scan electrode SC1 intersecting with data electrode Dk. Thus, an address discharge occurs in the discharge cells to be lit. Positive wall voltage accumulates on scan electrode SC1 and negative wall voltage accumulates on sustain electrode SU1. Negative wall voltage also accumulates on data electrode Dk.

In this manner, the address operation is performed so as to cause the address discharge in the discharge cells to be lit in the first row and accumulate wall voltages on the corresponding electrodes. On the other hand, the voltage in the intersecting parts of scan electrode SC1 and data electrode D1 through data electrode Dm applied with no address pulse voltage Vd does not exceed the breakdown voltage, and thus no address discharge occurs. The above address operation is repeated until the operation reaches the discharge cells in the n-th row, and the address period is completed.

In the subsequent sustain period, sustain pulses equal in number to the luminance weight multiplied by a predetermined luminance magnification are alternately applied to display electrode pairs 24. Thereby, a sustain discharge is caused in the discharge cells having undergone the address discharge, for light emission.

In this sustain period, first, positive sustain pulse voltage Vs is applied to scan electrode SC1 through scan electrode SCn, and the ground potential as a base potential, i.e. 0 (V), is applied to sustain electrode SU1 through sustain electrode SUn. Then, in the discharge cells having undergone the address discharge, the voltage difference between scan electrode SCi and sustain electrode SUi is obtained by adding the difference between the wall voltage on scan electrode SCi and the wall voltage on sustain electrode SUi to sustain pulse voltage Vs, and thus exceeds the breakdown voltage.

Then, a sustain discharge occurs between scan electrode SCi and sustain electrode SUi, and ultraviolet light generated at this time causes phosphor layers 35 to emit light. Thus, negative wall voltage accumulates on scan electrode SCi, and positive wall voltage accumulates on sustain electrode SUi. Positive wall voltage also accumulates on data electrode Dk. In the discharge cells having undergone no address discharge in the address period, no sustain discharge occurs and the wall voltage at the completion of the initializing period is maintained.

Subsequently, 0 (V) as the base potential is applied to scan electrode SC1 through scan electrode SCn, and sustain pulse voltage Vs is applied to sustain electrode SU1 through sustain electrode SUn. In the discharge cell having undergone the sustain discharge, the voltage difference between sustain electrode SUi and scan electrode SCi exceeds the breakdown voltage. Thereby, a sustain discharge occurs between sustain electrode SUi and scan electrode SCi again. Thus, negative wall voltage accumulates on sustain electrode SUi, and positive wall voltage accumulates on scan electrode SCi. Similarly, sustain pulses equal in number to the luminance weight multiplied by the luminance magnification are alternately applied to scan electrode SC1 through scan electrode SCn and sustain electrode SU1 through sustain electrode SUn so as to cause a potential difference between the electrodes of display electrode pairs 24. Thereby, the sustain discharge is continued in the discharge cells having undergone the address discharge in the address period.

After the sustain pulses have been generated in the sustain period, ramp voltage (hereinafter, referred to as "erasing ramp voltage") L3, which gradually rises from 0 (V) toward voltage Vers, is applied to scan electrode SC1 through scan electrode SCn. Thereby, in the discharge cells having undergone the sustain discharge, a weak discharge is continuously caused, and a part or the whole of the wall voltages on scan electrode SCi and sustain electrode SUi is erased while the positive wall voltage is left on data electrode Dk.

The respective operations in the subsequent second SF and thereafter are substantially similar to the above operation except for the numbers of sustain pulses in the sustain periods, and thus the description is omitted. The above description has outlined the driving voltage waveforms applied to the respective electrodes of panel 10 in this exemplary embodiment.

Figure 4:
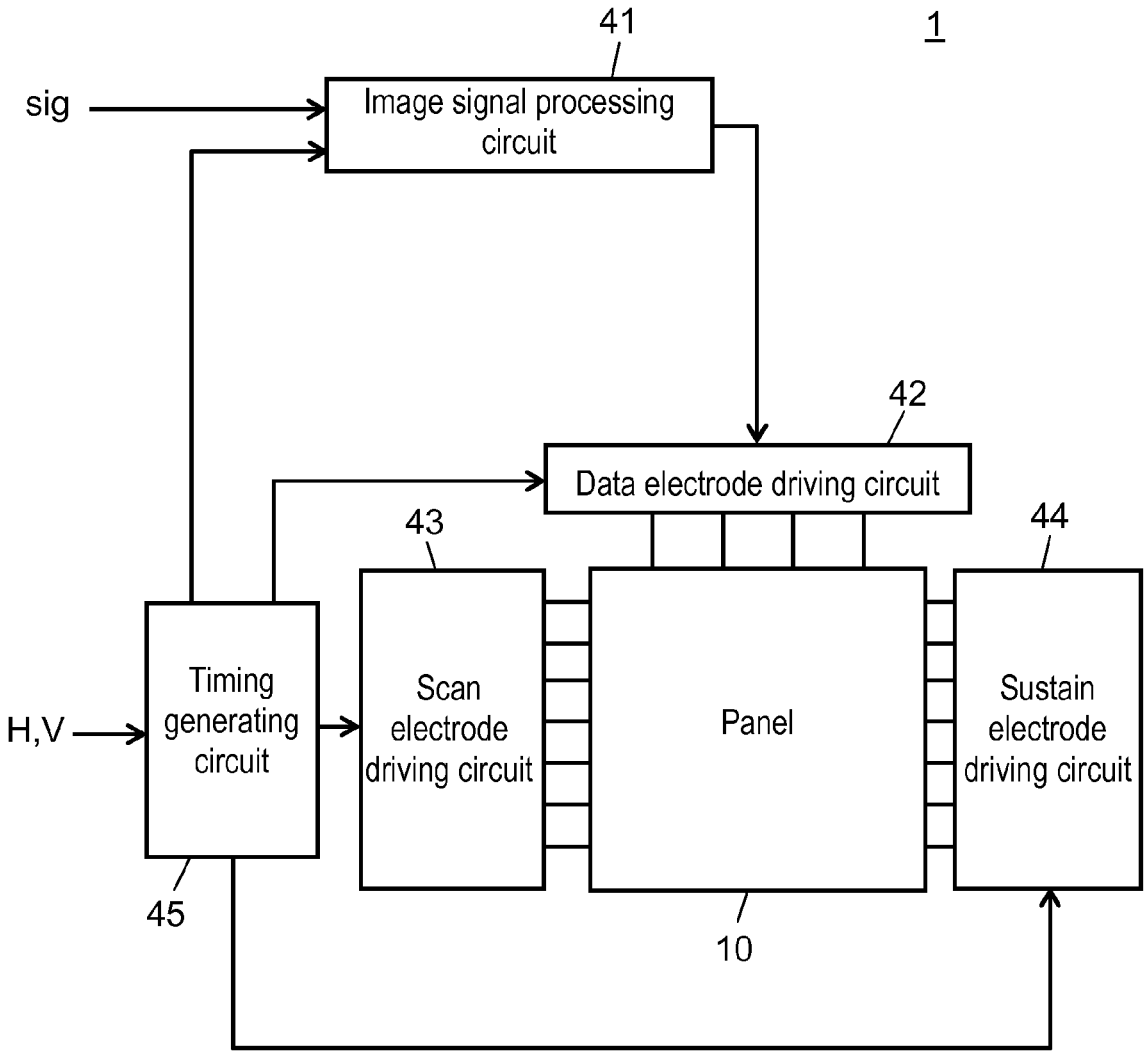
FIG. 4 is a circuit block diagram of a plasma display device in accordance with the exemplary embodiment of the present invention.

Next, a structure of a plasma display device in this exemplary embodiment is described. FIG. 4 is a circuit block diagram of plasma display device 1 in accordance with the exemplary embodiment of the present invention. Plasma display device 1 has the following elements:

panel 10;
image signal processing circuit 41;
data electrode driving circuit 42;
scan electrode driving circuit 43;
sustain electrode driving circuit 44;
timing generating circuit 45; and
power supply circuits (not shown) for supplying power necessary for each circuit block.

Image signal processing circuit 41 converts input image signal sig to image data showing light emission and no light emission in the discharge cells in each subfield.

Timing generating circuit 45 generates various timing signals for controlling the operation of each circuit block according to horizontal synchronizing signal H and vertical synchronizing signal V, and supplies the timing signals to each circuit block.

Scan electrode driving circuit 43 has the following elements:

an initializing waveform generating circuit for generating initializing waveform voltages to be applied to scan electrode SC1 through scan electrode SCn in the initializing periods;
a sustain pulse generating circuit for generating sustain pulses to be applied to scan electrode SC1 through scan electrode SCn in the sustain periods; and
a scan pulse generating circuit having a plurality of scan ICs, for generating scan pulse voltage Va to be applied to scan electrode SC1 through scan electrode SCn in the address periods (these circuits being not shown). The scan electrode driving circuit drives each of scan electrode SC1 through scan electrode SCn, in response to the timing signals.

Data electrode driving circuit 42 converts image data in each subfield into signals corresponding to each of data electrode D1 through data electrode Dm, and drives each of data electrode D1 through data electrode Dm, in response to the timing signals.

Sustain electrode driving circuit 44 has a sustain pulse generating circuit, and a circuit for generating voltage Ve1 and voltage Ve2 (these circuits being not shown), and drives sustain electrode SU1 through sustain electrode SUn, in response to the timing signals.

Figure 5A:
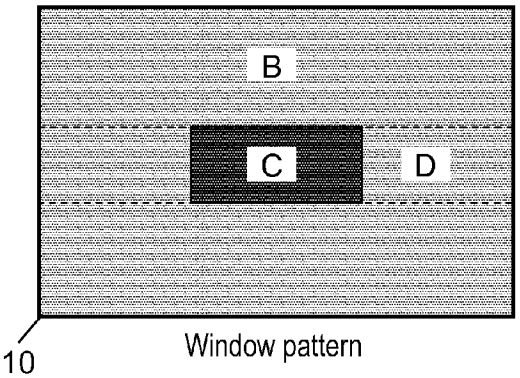
FIG. 5A is a schematic diagram for explaining a difference in emission luminance caused by a change in drive load.
Figure 5B:
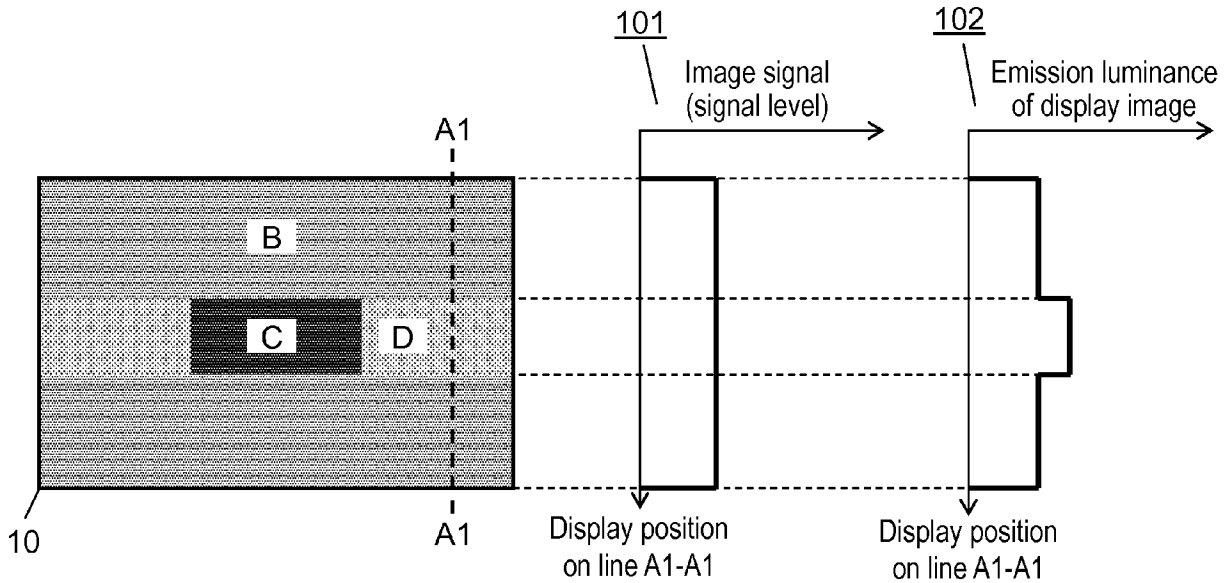
FIG. 5B is a schematic diagram for explaining the difference in emission luminance caused by the change in drive load.

Next, a description is provided for a difference in emission luminance caused by a change in drive load. FIG. 5A and FIG. 5B are schematic diagrams for explaining a difference in emission luminance caused by a change in drive load. FIG. 5A shows an ideal display image when an image generally called "window pattern" is displayed on panel 10. Region B and region D shown in the drawings are at an equal signal level (e.g. 20%), and region C is at a signal level (e.g. 5%) lower than that of region B and region D. The "signal level" in this exemplary embodiment may be the gradation value of a luminance signal, or may be the gradation value of an R signal, the gradation value of a B signal, or the gradation value of a G signal.

FIG. 5B includes a diagram schematically showing a display image when the "window pattern" of FIG. 5A is shown on panel 10, and diagrams showing signal level 101 and emission luminance 102. In panel 10 of FIG. 5B, display electrode pairs 24 are arranged so as to extend in the row direction (the transverse direction in the drawing), similar to those of panel 10 shown in FIG. 2. Signal level 101 of FIG. 5B shows a signal level of an image signal on line A1-A1 shown in panel 10 of FIG. 5B. The horizontal axis shows the magnitude of the signal level of the image signal; the vertical axis shows the display position on line A1-A1 in panel 10. Emission luminance 102 of FIG. 5B shows an emission luminance of a display image on line A1-A1 shown in panel 10 of FIG. 5B. The horizontal axis shows the magnitude of the emission luminance of the display image; the vertical axis shows the display position on line A1-A1 in panel 10.

As shown in FIG. 5B, when the "window pattern" is displayed on panel 10, region B and region D may have different emission luminances as shown in emission luminance 102 even though region B and region D are at an equal signal level as shown in signal level 101. This is considered for the following reason.

Display electrode pairs 24 are arranged so as to extend in the row direction (the transverse direction in the drawing). Thus, when the "window pattern" is displayed on panel 10 as shown in panel 10 of FIG. 5B, some of display electrode pairs 24 pass only through region B and some of display electrode pairs 24 pass through both region C and region D. The drive load of display electrode pairs 24 passing through region C and region D is smaller than the drive load of display electrode pairs 24 passing through region B. This is because a lower signal level of region C makes the discharge current that flows through display electrode pairs 24 passing through region C and region D smaller than the discharge current that flows through display electrode pairs 24 passing through region B.

Therefore, in display electrode pairs 24 passing through region C and region D, a voltage drop in drive voltage, e.g. a voltage drop in sustain pulses, is smaller than that in display electrode pairs 24 passing through region B. That is, the following phenomenon is considered to occur. The voltage drop in sustain pulses in display electrode pairs 24 passing through region C and region D is smaller than that in display electrode pairs 24 passing through region B, and thus the discharge intensity of the sustain discharge in the discharge cells in region D is higher than that of the sustain discharge in the discharge cells in region B. As a result, region D has an emission luminance higher than that of region B, even through both regions are at an equal signal level. Hereinafter, such a phenomenon is referred to as "loading phenomenon".

Figure 6A:
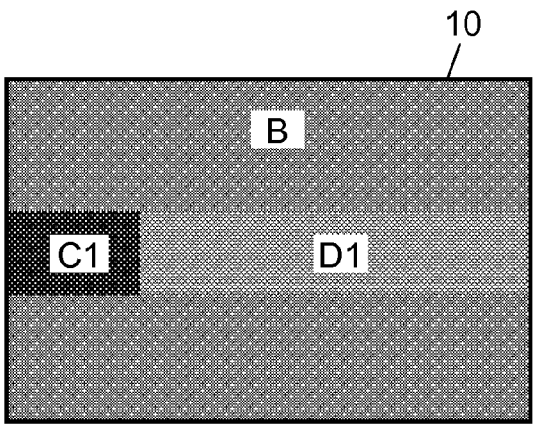
FIG. 6A is a diagram for schematically explaining a loading phenomenon.
Figure 6B:
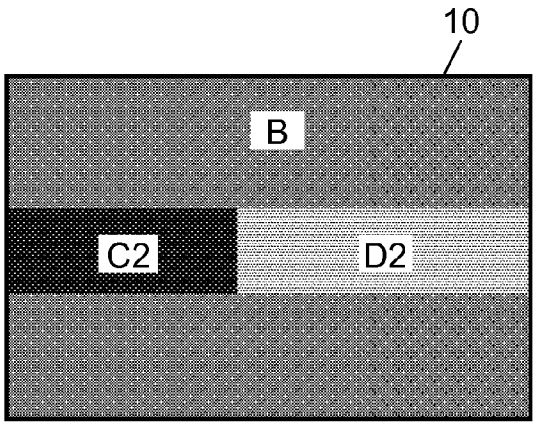
FIG. 6B is a diagram for schematically explaining a loading phenomenon.
Figure 6C:
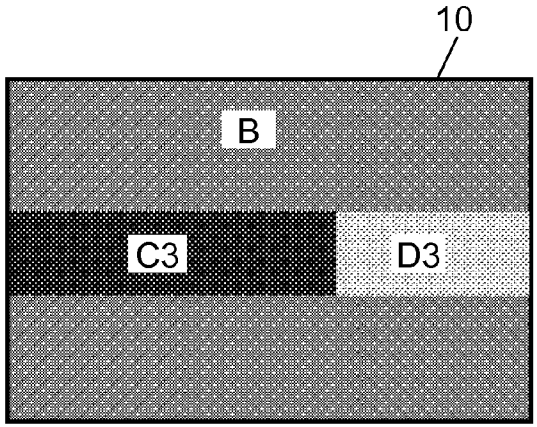
FIG. 6C is a diagram for schematically explaining a loading phenomenon.
Figure 6D:
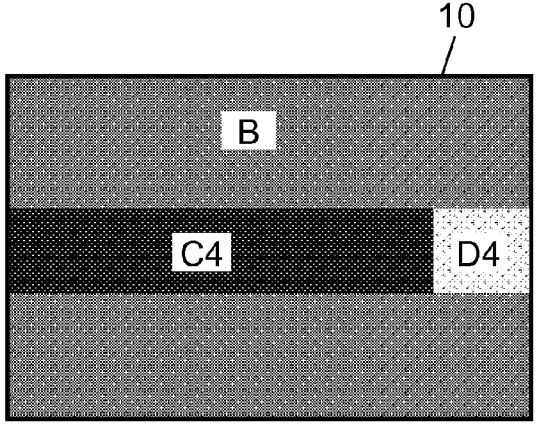
FIG. 6D is a diagram for schematically explaining a loading phenomenon.

FIG. 6A, FIG. 6B, FIG. 6C, and FIG. 6D are diagrams each for schematically explaining a loading phenomenon. Each of these drawings schematically shows a display image displayed on panel 10 while the area of region C at a low signal level (e.g. 5%) in the "window pattern" is gradually changed. Each of region D1 in FIG. 6A, region D2 in FIG. 6B, region D3 in FIG. 6C, and region D4 in FIG. 6D is at a signal level (e.g. 20%) equal to that of region B.

As shown in FIG. 6A, FIG. 6B, FIG. 6C, and FIG. 6D, as the area of region C increases in the order of region C1, region C2, region C3, and region C4, the drive load of display electrode pairs 24 passing through region C and region D decreases. As a result, the discharge intensity of the discharge cells in region D increases and the emission luminance in region D gradually increases in the order of region D1, region D2, region D3, and region D4. In this manner, the emission luminance increased by a loading phenomenon changes as the drive load varies. This exemplary embodiment is intended to reduce this loading phenomenon and enhance the image display quality in plasma display device 1. In this exemplary embodiment, the processing performed to reduce the loading phenomenon is referred to as "loading correction".

Figure 7:
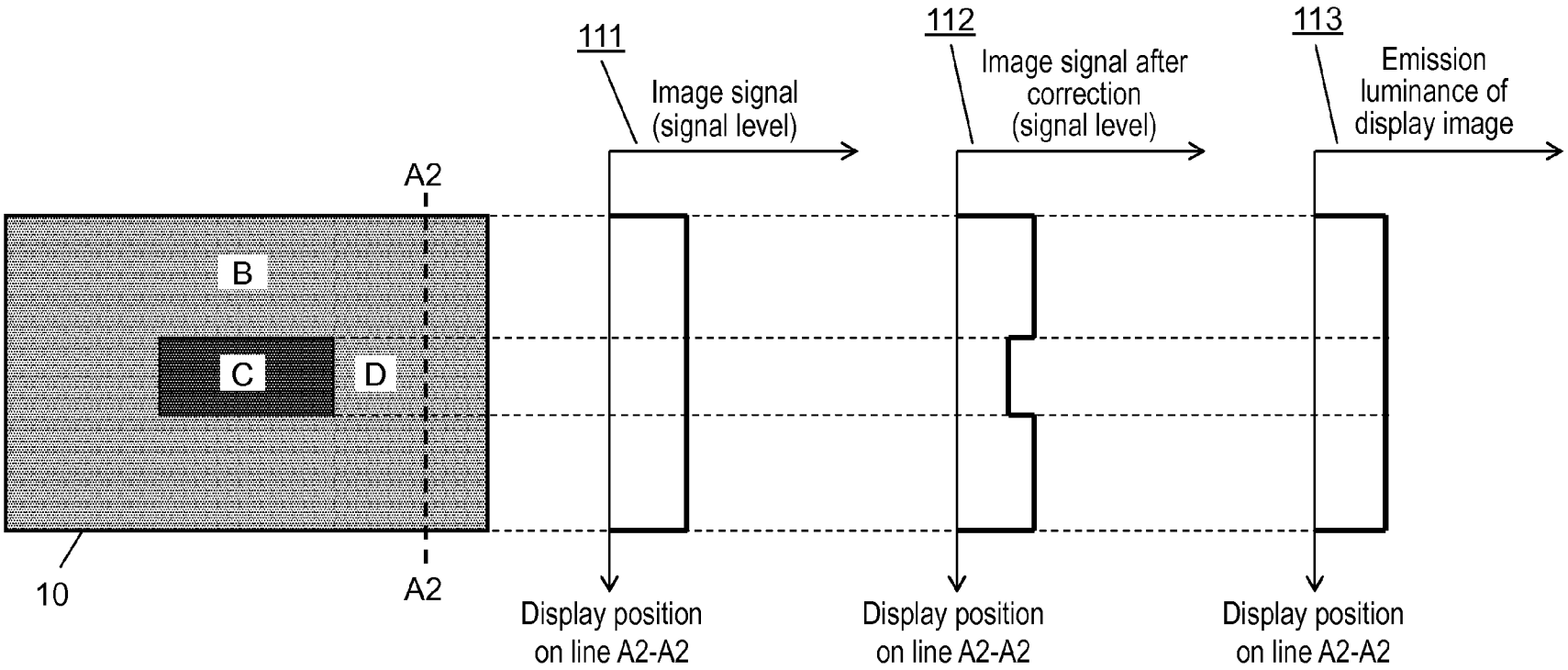
FIG. 7 is a diagram for schematically explaining loading correction in accordance with the exemplary embodiment of the present invention.

FIG. 7 is a diagram for schematically explaining loading correction in accordance with the exemplary embodiment of the present invention. This drawing includes a diagram schematically showing a display image when the "window pattern" of FIG. 5A is shown on panel 10, and diagrams showing signal level 111, signal level 112, and emission luminance 113. The display image in panel 10 of FIG. 7 schematically shows a display image when the "window pattern" of FIG. 5A is displayed on panel 10 after the loading correction of this exemplary embodiment has been performed. Signal level 111 of FIG. 7 shows a signal level of an image signal on line A2-A2 shown in panel 10 of FIG. 7. The horizontal axis shows the magnitude of the signal level of the image signal; the vertical axis shows the display position on line A2-A2 in panel 10. Signal level 112 of FIG. 7 shows the signal level of the image signal on line A2-A2 after the loading correction of this exemplary embodiment has been performed. The horizontal axis shows the magnitude of the signal level of the image signal after the loading correction; the vertical axis shows the display position on line A2-A2 in panel 10. Emission luminance 113 of FIG. 7 shows an emission luminance of the display image on line A2-A2. The horizontal axis shows the magnitude of the emission luminance of the display image; the vertical axis shows the display position on line A2-A2 in panel 10.

In this exemplary embodiment, loading correction is performed in the following manner. For each discharge cell, a correction value based on the drive load of display electrode pair 24 passing through the discharge cell is calculated so as to correct the image signal. For example, when an image as shown in panel 10 of FIG. 7 is displayed on panel 10, it is determined that display electrode pairs 24 passing through region D also pass through region C and thus have a smaller drive load, although region B and region D are at an equal signal level. Then, the signal level of region D is corrected as shown in signal level 112 of FIG. 7. With this correction, as shown in emission luminance 113 of FIG. 7, the magnitudes of emission luminance in region B and region C in the display image are equalized so that the loading phenomenon is reduced.

In this manner, the image signal in a region where a loading phenomenon is likely to occur is corrected such that the emission luminance in the region of the display image is reduced. Thereby, the loading phenomenon is reduced. At this time, in this exemplary embodiment, a correction gain for loading correction is calculated according to the drive load and the position of the discharge cell in the row direction of panel 10, and the loading correction is performed using the correction gain.

The loading correction in this exemplary embodiment is detailed.

Figure 8:
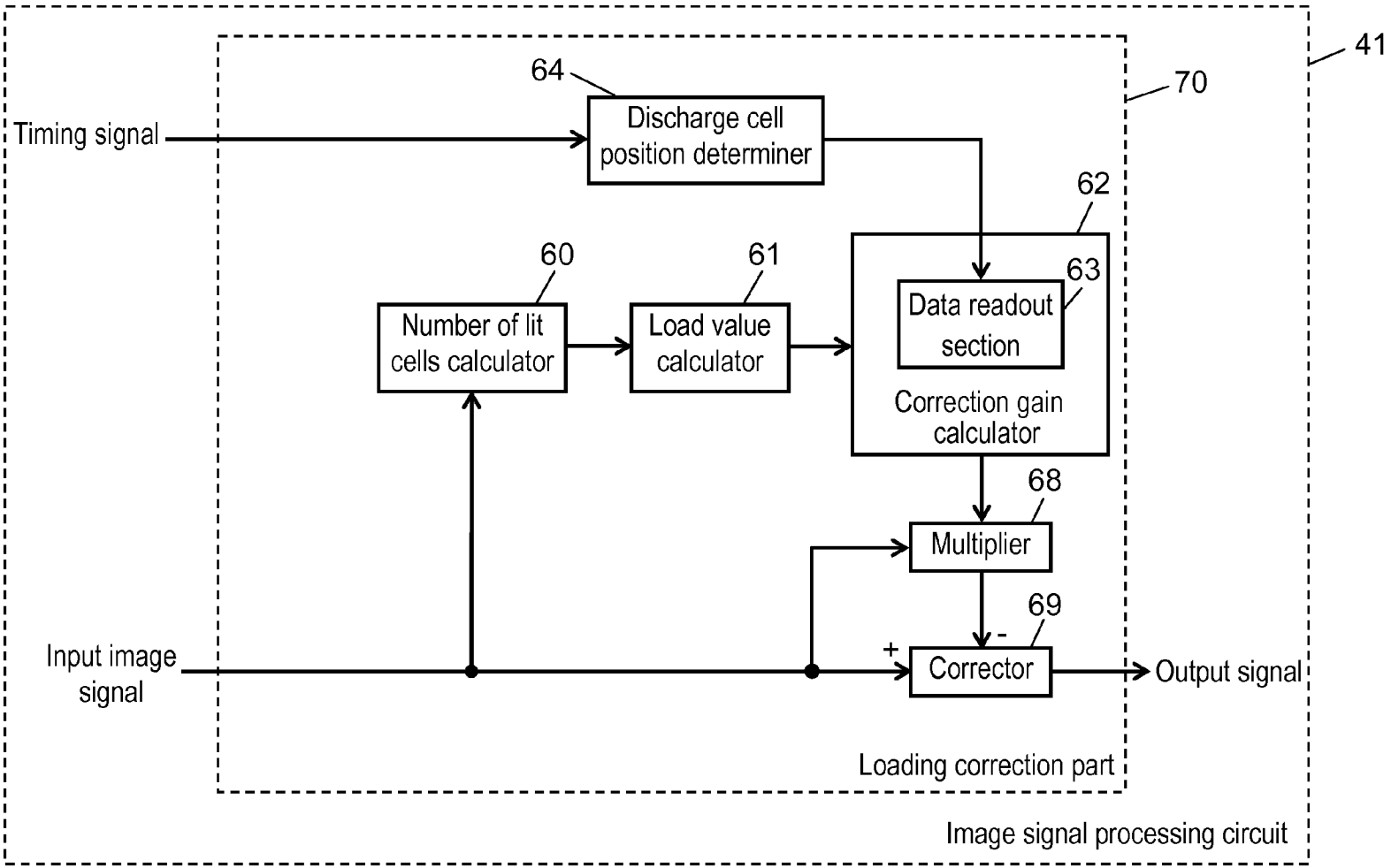
FIG. 8 is a circuit block diagram of an image signal processing circuit in accordance with the exemplary embodiment.

FIG. 8 is a circuit block diagram of image signal processing circuit 41 in accordance with the exemplary embodiment of the present invention. In FIG. 8, the blocks related to the loading correction in this exemplary embodiment are shown, and the other circuit blocks are omitted.

Image signal processing circuit 41 has loading correction part 70 including the following elements:

number of lit cells calculator 60;
load value calculator 61;
correction gain calculator 62;
discharge cell position determiner 64;
multiplier 68; and
corrector 69.

Number of lit cells calculator 60 calculates the number of discharge cells to be lit (hereinafter, a discharge cell to be lit being referred to as "lit cell", and a discharge cell to be unlit as "unlit cell") in each display electrode pair 24, in each subfield.

Upon receiving the calculation result in number of lit cells calculator 60, load value calculator 61 performs operations based on the method for calculating a drive load in this exemplary embodiment (calculation of a "load value" and a "maximum load value" to be described later, in this exemplary embodiment).

In response to the timing signals, discharge cell position determiner 64 determines the position of a discharge cell of which correction gain is to be calculated in correction gain calculator 62 (hereinafter, referred to as "focused discharge cell") in the row direction (the position in the extending direction of display electrode pair 24).

Correction gain calculator 62 has data readout section 63, which stores the data on correction amounts to be used in calculation of correction gains, and reads out a correction amount, according to the position determination result of the discharge cell output from discharge cell position determiner 64. The correction gain calculator calculates a correction gain, according to the correction amount read out from data readout section 63 and the calculation result in load value calculator 61. This correction amount will be described later.

Multiplier 68 multiplies an image signal by the correction gain output from correction gain calculator 62, and outputs the obtained result as a correction signal. Corrector 69 subtracts the correction signal output from multiplier 68, from the image signal, and outputs the obtained result as the image signal after correction.

Next, the method for calculating a correction gain in this exemplary embodiment is described. In this exemplary embodiment, this operation is performed in number of lit cells calculator 60, load value calculator 61, discharge cell position determiner 64, and correction gain calculator 62.

In this exemplary embodiment, two numerical values referred to as "load value" and "maximum load value" are calculated, according to the calculation result in number of lit cells calculator 60. These "load value" and "maximum load value" are the numerical values to be used to estimate the loading phenomenon amount in a focused discharge cell.

Figure 9:
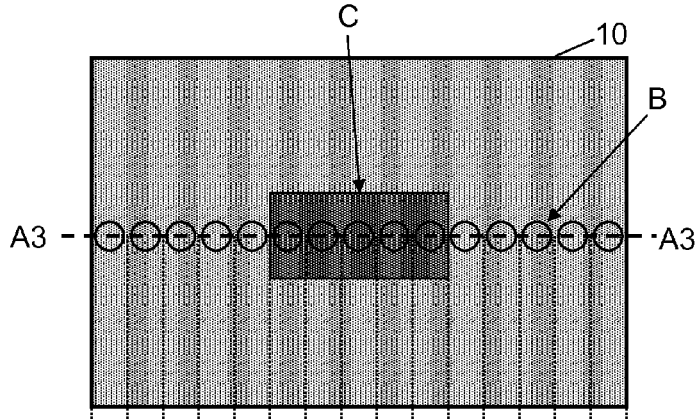
FIG. 9 is a schematic chart for explaining a method for calculating a "load value" in accordance with the exemplary embodiment.

First, a description is provided for the "load value" in this exemplary embodiment, with reference to FIG. 9. Next, a description is provided for the "maximum load value" in this exemplary embodiment, with reference to FIG. 10.

FIG. 9 is a schematic chart for explaining a method for calculating a "load value" in accordance with the exemplary embodiment of the present invention. This drawing shows a schematic diagram of the display image of the "window pattern" of FIG. 5A displayed on panel 10, and lighting state 121 and calculated value 122. Lighting state 121 of FIG. 9 is a schematic chart showing lighting or non-lighting of each discharge cell on line A3-A3 in panel 10 of FIG. 9 in each subfield. The horizontal columns show display positions on line A3-A3 in panel 10; the vertical columns show the subfields. Further, "1" shows lighting, and the blank shows non-lighting. Calculated value 122 of FIG. 9 is a chart schematically showing the method for calculating a "load value" in this exemplary embodiment. The horizontal columns show "number of lit cells", "luminance weight", "lighting state of discharge cell B", and "calculated value" in this order from the left of the chart; the vertical columns show the subfields. In this exemplary embodiment, for simplifying the explanation, the number of discharge cells in the row direction is set to 15. Therefore, the following description is provided, assuming that 15 discharge cells are disposed on line A3-A3 in panel 10 of FIG. 9. Actually, the following operations are performed on the number of discharge cells in the row direction of panel 10 (e.g. 1920×3).

Assume that the lighting states of 15 discharge cells disposed on line A3-A3 in panel 10 of FIG. 9 in the respective subfields are as shown in lighting state 121, for example. That is, five discharge cells in the center included in region C in panel 10 of FIG. 9 are lit in the first SF through the third SF, and unlit in the fourth SF through the eighth SF. Further, five discharge cells on the left side and five discharge cells on the right side excluded from region C are lit in the first SF through the sixth SF, and unlit in the seventh SF and the eighth SF.

When the 15 discharge cells disposed on line A3-A3 are in such a lighting state, the "load value" of one of the discharge cells, e.g. discharge cell B in the drawing, is obtained in the following manner.

First, the number of lit cells in each subfield is calculated. Since all the 15 discharge cells on line A3-A3 are lit in the first SF through the third SF, the number of lit cells in each of the first SF through the third SF is 15, as shown in the columns under "number of lit cells" corresponding to the first SF through the third SF in calculated value 122 of FIG. 9. Next, since 10 out of the 15 discharge cells on line A3-A3 are lit in the fourth SF through the sixth SF, the number of lit cells in each of the fourth SF through the sixth SF is 10, as shown in the columns under "number of lit cells" corresponding to the fourth SF through the sixth SF in calculated value 122. Next, since all the 15 discharge cells on line A3-A3 are unlit in the seventh SF and the eighth SF, the number of lit cells in each of the seventh SF and the eighth SF is 0, as shown in the columns under "number of lit cells" corresponding to the seventh SF and the eighth SF in calculated value 122.

Next, the number of lit cells in each subfield thus obtained is multiplied by the luminance weight and the lighting state of discharge cell B in the corresponding subfield. In this exemplary embodiment, as shown in the respective columns under "luminance weight" corresponding to the first SF through the eighth SF in calculated value 122 of FIG. 9, the luminance weights of the respective subfields are 1, 2, 4, 8, 16, 32, 64, and 128 in this order from the first SF. In this exemplary embodiment, lighting is 1 and non-lighting is 0. Therefore, as shown in the respective columns under "lighting state of discharge cell B" corresponding to the first SF through the eighth SF in calculated value 122, the lighting states of discharge cell B are 1, 1, 1, 1, 1, 1, 0, and 0 in this order from the first SF. As shown in the respective columns under "calculated value" corresponding to the first SF through the eighth SF in calculated value 122, the multiplication results are 15, 30, 60, 80, 160, 320, 0, and 0 in this order from the first SF. Then, the total sum of the calculated values is obtained. In the example shown in calculated value 122 of FIG. 9, the total sum of the calculated values is 665. This total sum is the "load value" in discharge cell B. In this exemplary embodiment, such operations are performed on each discharge cell, and thus a "load value" is obtained for each discharge cell.

Figure 10:
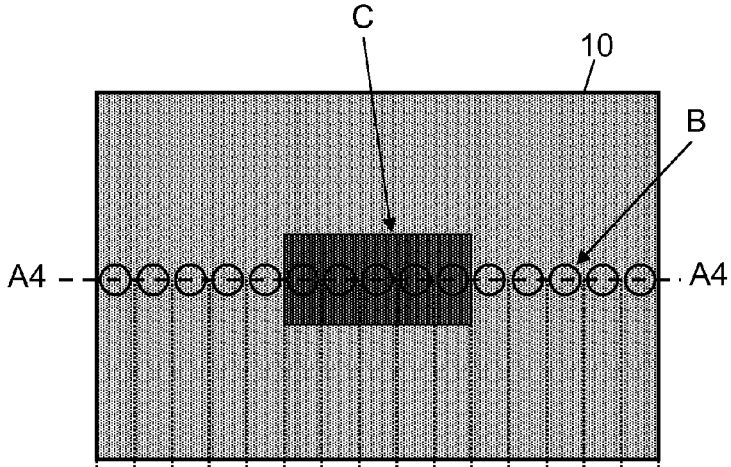
FIG. 10 is a schematic chart for explaining a method for calculating a "maximum load value" in accordance with the exemplary embodiment.

FIG. 10 is a schematic chart for explaining a method for calculating a "maximum load value" in accordance with the exemplary embodiment of the present invention. This drawing shows a schematic diagram of the display image of the "window pattern" of FIG. 5A displayed on panel 10, and lighting state 131 and calculated value 132. Lighting state 131 of FIG. 10 is a schematic chart showing lighting or non-lighting in each subfield when the lighting state of discharge cell B is applied to all the discharge cells on line A4-A4 in panel 10 of FIG. 10 for calculation of the "maximum load value". The horizontal columns show display positions on line A4-A4 in panel 10; the vertical columns show the subfields. Calculated value 132 of FIG. 10 is a chart schematically showing the method for calculating a "maximum load value" in this exemplary embodiment. The horizontal columns show "number of lit cells", "luminance weight", "lighting state of discharge cell B", and "calculated value" in this order from the left of the chart, and the vertical columns show the subfields.

In this exemplary embodiment, a "maximum load value" is calculated in the following manner. For calculation of the "maximum load value" in discharge cell B, for example, the number of lit cells in each subfield is calculated, assuming that every discharge cell on line A4-A4 is in a lighting state equal to that of discharge cell B, as shown in lighting state 131 of FIG. 10. As shown in the respective columns under "lighting state of discharge cell B" corresponding to the first SF through the eighth SF in calculated value 122 of FIG. 9, the lighting states of discharge cell B in the respective subfields are 1, 1, 1, 1, 1, 1, 0, and 0 in this order from the first SF. Then, the lighting states are allocated to all the discharge cells on line A4-A4. Therefore, the lighting states of all the discharge cells on line A4-A4 are 1 in the first SF through the sixth SF, and 0 in the seventh SF and the eighth SF, as shown in lighting state 131 of FIG. 10. As a result, the numbers of lit cells are 15, 15, 15, 15, 15, 15, 0, and 0 in this order from the first SF, as shown in the respective columns under "number of lit cells" corresponding to the first SF through the eighth SF in calculated value 132 of FIG. 10. However, in this exemplary embodiment, each of the discharge cells on line A4-A4 is not actually brought into the lighting states shown in lighting state 131. The lighting states shown in lighting state 131 are those when it is assumed that each of the discharge cells is brought into a lighting state equal to that of discharge cell B for calculation of the "maximum load value". The "numbers of lit cells" shown in calculated value 132 are the numbers of lit cells based on that assumption.

Next, the number of lit cells in each subfield thus obtained is multiplied by the luminance weight and the lighting state of discharge cell B in the corresponding subfield. As described above, in this exemplary embodiment, as shown in the respective columns under "luminance weight" corresponding to the first SF through the eighth SF in calculated value 132 of FIG. 10, the luminance weights of the respective subfields are 1, 2, 4, 8, 16, 32, 64, and 128 in this order from the first SF. Further, as shown in the respective columns under "lighting state of discharge cell B" corresponding to the first SF through the eighth SF in calculated value 132, the lighting states of discharge cell B are 1, 1, 1, 1, 1, 1, 0, and 0 in this order from the first SF. Therefore, as shown in the respective columns under "calculated value" corresponding to the first SF through the eighth SF in calculated value 132, the multiplication results are 15, 30, 60, 120, 240, 480, 0, and 0 in this order from the first SF. Then, the total sum of the calculated values is obtained. In the example shown in calculated value 132 of FIG. 10, the total sum of the calculated values is 945. This total sum is the "maximum load value" in discharge cell B. In this exemplary embodiment, such operations are performed on each discharge cell, and thus a "maximum load value" is obtained for each discharge cell.

The "maximum load value" in discharge cell B may be obtained also in the following manner. The number of all discharge cells on display electrode pair 24 (15, in this example) is multiplied by the luminance weights of the respective subfields (e.g. 1, 2, 4, 8, 16, 32, 64, and 128 in this order from the first SF). Next, each multiplication result and the lighting state of discharge cell B in the corresponding subfield (e.g. 1, 1, 1, 1, 1, 1, 0, and 0 in this order from the first SF) are multiplied. Then, the total sum of these calculated values (15, 30, 60, 120, 240, 480, 0, and 0 in this order from the first SF, in this example) is obtained. Also by such a calculation method, the result equal to that of the above operations (945, in this example) can be obtained.

Further, in this exemplary embodiment, using a numerical value obtained with the following Expression (1), the correction gain in a focused discharge cell (discharge cell B) is calculated.

(Maximum load value−load value)/maximum load value Expression (1)

For example, from the "load value"=665 and the "maximum load value"=945 in the above discharge cell B, the following numerical value:

(945−665)/945=0.296 can be obtained. Using the thus calculated numerical value in the following Expression (2), the correction gain is calculated. That is, the correction gain is obtained by multiplying the result of Expression (1) by a predetermined coefficient (a coefficient predetermined according to the characteristics of panel 10, for example), and further by a predetermined correction amount based on the position of the discharge cell in the row direction of panel 10.

Correction gain=result of Expression (1)×predetermined coefficient×correction amount Expression (2)

Then, this correction gain is substituted into the following Expression (3) so as to correct the input image signal.

Output image signal=input image signal−input image signal×correction gain Expression (3)

This operation can suppress an unnecessary increase in the luminance in the region where a loading phenomenon is likely to occur, and reduce the loading phenomenon.

As shown in Expression (2), in this exemplary embodiment, the correction gain is calculated according to the position of the discharge cell in the row direction of panel 10, for the following reason.

In a generally-viewed dynamic image, e.g. a television broadcast, a gazed portion, e.g. a human face, is relatively frequently positioned in the vicinity of the center of the display surface. For this reason, the brightness of the central portion of the display surface is likely to be recognized as the brightness of the display image. Thus, when the central portion of the display surface has a low luminance, the user may have an impression that the display image is dark. In contrast, the peripheral portion of the display surface is relatively rarely gazed, and thus the brightness of the peripheral portion exerts a smaller influence on the display image than the brightness of the central portion. Further, the brightness of the display image is one of important factors in determining the image display quality. A decrease in the luminance of the display image can be recognized as a deterioration of the image display quality in some cases, although it depends on the viewing environment of the plasma display device.

For this reason, in this exemplary embodiment, a correction gain is calculated, using the correction amount based on the position of the discharge cell and the numerical value calculated with Expression (1), such that the correction gain is smaller in the central portion than in the peripheral portion on the image display surface of panel 10. The thus obtained correction gain is used for loading correction.

Figure 11:
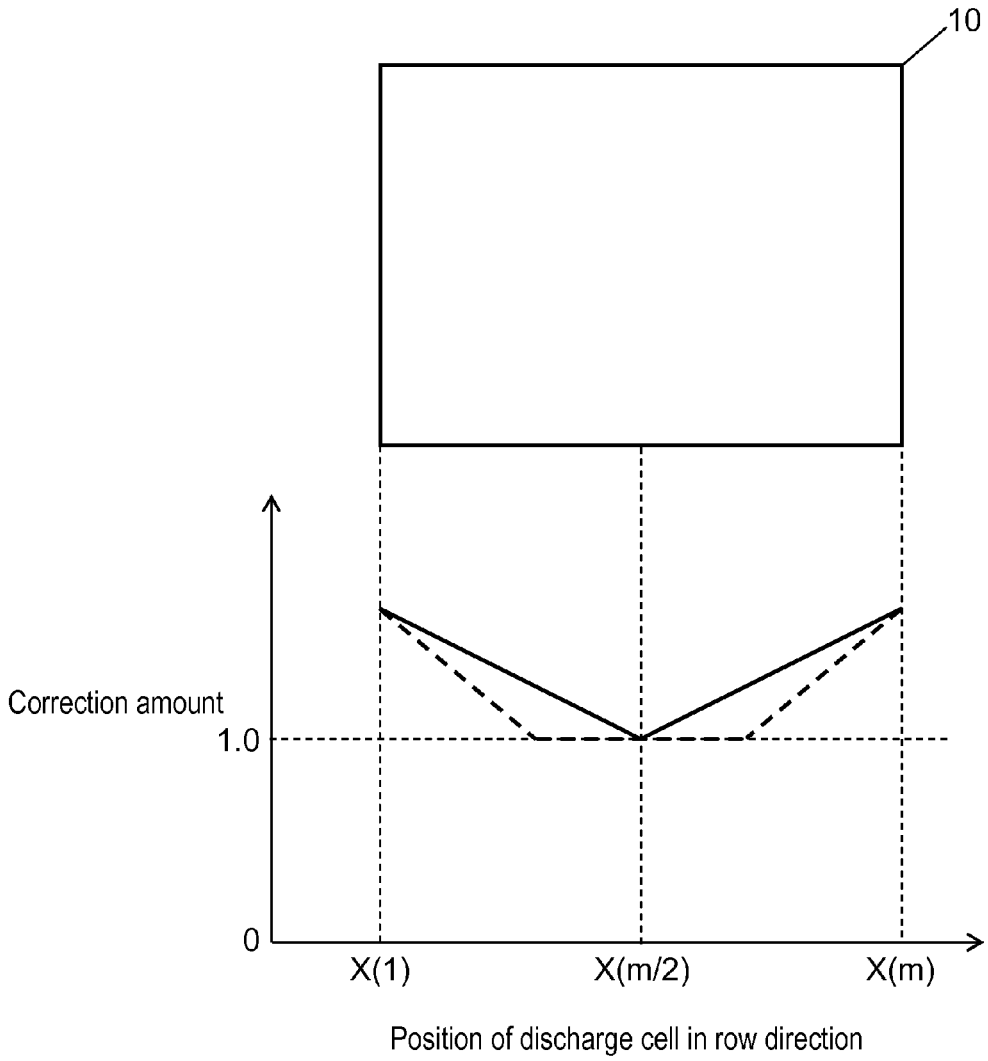
FIG. 11 is a chart schematically showing a correction amount based on the position of a discharge cell in the row direction in accordance with the exemplary embodiment.

FIG. 11 is a chart schematically showing a correction amount based on the position of a discharge cell in the row direction in accordance with the exemplary embodiment of the present invention.

In this exemplary embodiment, as shown by the solid line in FIG. 11, the correction amount is set such that the correction gain is smaller in the discharge cell at the center of panel 10 (e.g. the discharge cell positioned at X (m/2) in the drawing) than in each of the discharge cells at both ends in the row direction of panel 10 (e.g. the discharge cell at X (1) or X (m)).

Then, the correction amount is determined according to the position of the focused discharge cell in the row direction, and the correction gain is calculated by multiplying the numerical value calculated with Expression (1) by the correction amount. The correction gain thus obtained is used for loading correction.

With this operation, the correction gain of the discharge cell at the center of panel 10 is made smaller than that in each of the discharge cells at both ends of panel 10, and thus the loading correction can be reduced from both ends toward the center of panel 10. Therefore, in the loading correction, the emission luminance in the discharge cell at the center of panel 10 is made higher than that in each of the discharge cells at both ends of panel 10. Thereby, the brightness of the display image can be improved.

That is, when an image where a loading phenomenon is likely to occur is displayed on panel 10, loading correction can be performed such that the correction gain is smaller in the central portion than in the peripheral portion of the display surface. This operation can uniformize the display luminance and improve the brightness of the display image.

The data on the correction amount of FIG. 11 is stored in data readout section 63 included in correction gain calculator 62.

FIG. 11 shows a structure for determining the correction amount according to the position of a discharge cell in the row direction. However, for example, a structure for determining the correction amount according to the position of the discharge cell in the column direction (i.e. the extending direction of data electrode 32, longitudinal direction of the drawing) may be used.

Figure 12:
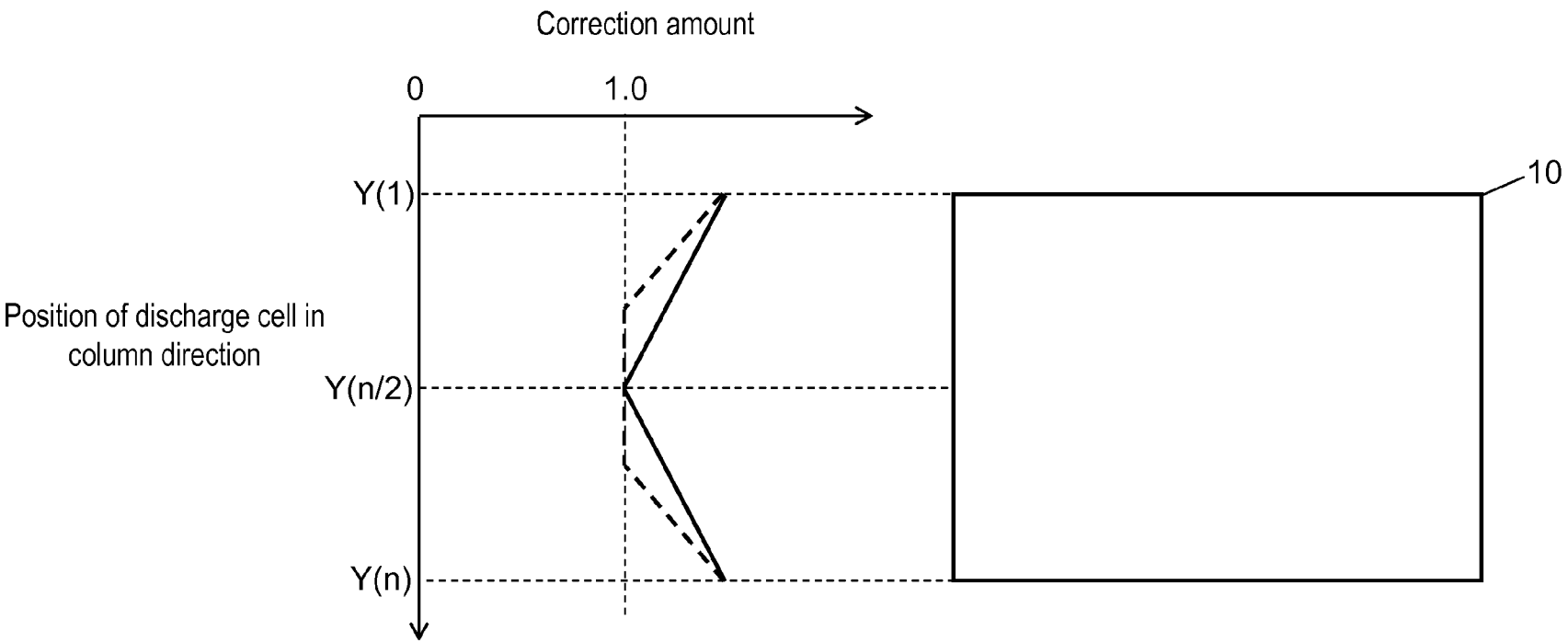
FIG. 12 is a chart schematically showing a correction amount based on the position of a discharge cell in the column direction in accordance with the exemplary embodiment.

FIG. 12 is a chart schematically showing a correction amount based on the position of a discharge cell in the column direction in accordance with the exemplary embodiment of the present invention.

For example, as shown by the solid line in FIG. 12, the correction amount may be set such that the correction gain is smaller in the discharge cell at the center of panel 10 (e.g. the discharge cell positioned at Y (n/2) in the drawing) than in each of the discharge cells at both ends in the column direction of panel 10 (e.g. the discharge cell at Y (1) or Y (n)).

Alternatively, the correction amount may be determined according to both of the position in the row direction and the position in the column direction of the discharge cell. In this structure, for example, data obtained by averaging the correction amount data of FIG. 11 and the correction amount data of FIG. 12 is used.

Even with these structures, when an image where a loading phenomenon is likely to occur is displayed on panel 10, the loading correction can be performed such that the correction gain is smaller in the central portion than in the peripheral portion of the display surface.

The position of a discharge cell in the column direction can be determined in discharge cell position determiner 64 in a manner similar to the determination of the position of the discharge cell in the row direction.

The correction amount of FIG. 11 and the correction amount of FIG. 12 can be set such that the emission luminance of the discharge cell at the center of panel 10 is 5%, for example, higher than the emission luminance of each of discharge cells at both ends of panel 10. However, preferably, these values are set to optimum values while the display image is checked.

The changes in the correction amounts of FIG. 11 and FIG. 12 may be those expressed by straight lines, as shown by the solid lines in FIG. 11 and FIG. 12. Alternatively, the changes may be those expressed by quadratic curves or other curves, or straight lines having varying gradients. However, preferably, the correction amount is changed per pixel, and set equal at least in three (R, G, and B) discharge cells forming one pixel.

In this exemplary embodiment, a description is provided for a structure where the correction amount is the smallest in the discharge cell at the center of panel 10 and the correction amount increases toward the ends, with reference to FIG. 11 and FIG. 12. However, the present invention is not limited to this structure. For example, as shown by the broken lines in FIG. 11 and FIG. 12, the correction amounts in discharge cells within a predetermined range from the center of panel 10 may be set constant.

In each of FIG. 11 and FIG. 12, the correction amount in the discharge cell at the center of panel 10 (the discharge cell positioned at X (m/2) in FIG. 11 or the discharge cell at Y (n/2) in FIG. 12) is set to 1.0. This is only because the predetermined coefficient to be used for calculating the correction gain shown in Expression (2) is set such that the correction amount in the discharge cell at the center of panel 10 is 1.0. In the present invention, the correction amount to be set according to the position of the discharge cell is not limited to the numerical value shown in FIG. 11 and FIG. 12. Preferably, the correction amount is set optimally for the characteristics of panel 10, the specifications of plasma display device 1, or the like.

As described above, in this exemplary embodiment, a "load value" and a "maximum load value" are calculated for each discharge cell. Further, a correction amount based on the position of the discharge cell is produced for calculation of a correction gain such that the correction gain is smaller in the central portion than in the peripheral portion on the display surface. With this structure, when an image where a loading phenomenon is likely to occur is displayed on panel 10, correction gains corresponding to the expected increases in the emission luminance can be calculated with high accuracy. Further, in the loading correction, the emission luminance in the discharge cell at the center of panel 10 can be made higher than that in each of the discharge cells at both ends of panel 10. Thereby, the brightness of the display image can be improved. Thus, when an image where a loading phenomenon is likely to occur is displayed on panel 10, this structure can uniformize the display luminance and improve the brightness of the display image. Therefore, this structure can enhance the image display quality in plasma display device 1 that uses panel 10 having a large screen and high definition.

In this exemplary embodiment, a description is provided for the structure where the luminance weight and the lighting state of a discharge cell in each subfield are multiplied, in calculation of the "load value" and the "maximum load value". Instead of the luminance weight, the number of sustain pulses in each subfield, for example, may be used.

When generally-used image processing called error diffusion is performed, the following problem can arise: an increase in the error amount diffused at a changing point of gradation values (a boundary of a pattern of a display image) emphasizes the boundary in the boundary portion having large luminance changes, and makes the image look unnatural. In order to reduce this problem, the present invention may be configured such that a correction value for error diffusion is randomly added to or subtracted from the calculated correction gain so as to give a random change to the correction gain. Such processing can reduce the problem of emphasizing the boundary of the pattern and making the image look unnatural in error diffusion.

Figure 13:
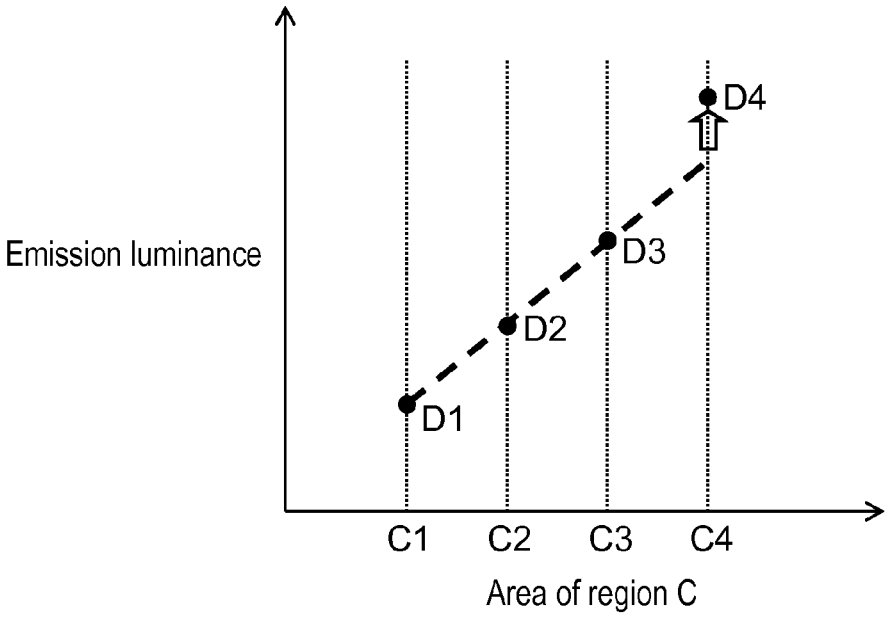
FIG. 13 is a chart showing an example of the relation between the area of region C and emission luminance in region D in a "window pattern".
Figure 14:
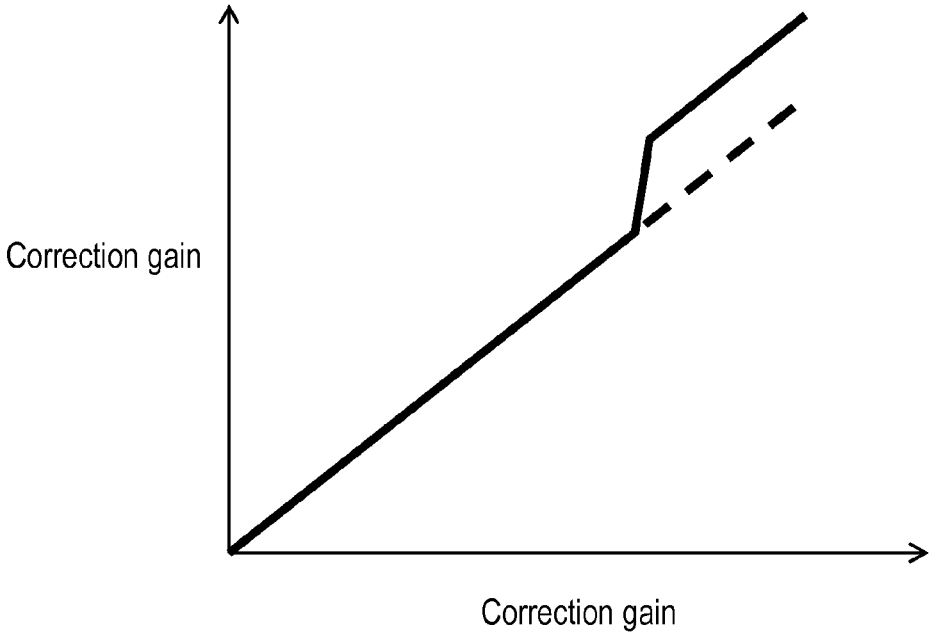
FIG. 14 is a characteristics chart showing an example of nonlinear processing of a correction gain in accordance with the exemplary embodiment of the present invention.

FIG. 6A, FIG. 6B, FIG. 6C, and FIG. 6D show an example where variations in the drive load change the emission luminance. However, depending on the characteristics of panel 10, the emission luminance not always changes linearly when a loading phenomenon occurs. FIG. 13 is a chart showing an example of the relation between the area of region C and the emission luminance in region D in the "window pattern" shown in FIG. 6A, FIG. 6B, FIG. 6C, and FIG. 6D. In some types of panel 10, when the area of region C increases (e.g. C4 in FIG. 6D), i.e. when the drive load of display electrode pairs 24 decreases, the loading phenomenon can become extremely severe and considerably increase the emission luminance in region D (e.g. D4 in FIG. 6D). The present invention may be configured such that the correction gain is weighted and nonlinearly changed according to the characteristics of such panel 10. FIG. 14 is a characteristics chart showing an example of nonlinear processing of a correction gain in accordance with the exemplary embodiment of the present invention. For example, a plurality of correction gains set according to the characteristics of panel 10 is prestored in a lookup table, and one of the correction gains is read out from the lookup table according to the calculation result of the correction gain. With this structure, as shown in FIG. 14, correction gains can be set nonlinearly.

When an image output from a computer, for example, is displayed, it is highly possible that any portion of the display surface is to be gazed. For this reason, when an output image of a computer, for example, is displayed on panel 10, it is preferable to stop the operation of discharge cell position determiner 64, and use the result obtained by multiplying the result of Expression (1) only by a predetermined coefficient, as a correction gain for the loading correction.

In the exemplary embodiment of the present invention, a description is provided for a structure where a luminance weight is used to calculate a load value. However, the present invention may be configured such that, instead of the luminance weight, the number of sustain pulses, for example, is used.

The exemplary embodiment of the present invention can also be applied to a method for driving a panel by so-called two-phase driving. In the two-phase driving, scan electrode SC1 through scan electrode SCn are divided into a first scan electrode group and a second scan electrode group. Further, each address period is divided into two address periods: a first address period where a scan pulse is applied to each scan electrode belonging to a first scan electrode group; and a second address period where the scan pulse is applied to each scan electrode belonging to a second scan electrode group. Also in the two-phase driving, advantages similar to the above can be obtained.

The exemplary embodiment of the present invention is also effective in a panel having an electrode structure where a scan electrode is adjacent to a scan electrode and a sustain electrode is adjacent to a sustain electrode. In this electrode structure (referred to as "ABBA electrode structure"), the electrodes are arranged on the front plate in the following order: a scan electrode, a scan electrode, a sustain electrode, a sustain electrode, a scan electrode, a scan electrode, or the like.

The specific numerical values in the exemplary embodiment are set according to the characteristics of a 50-inch diagonal panel having 1080 display electrode pairs, and only show examples in the exemplary embodiment. The present invention is not limited to these numerical values. Preferably, the numerical values are set optimally for the characteristics of the panel, the specifications of the plasma display device, or the like. For each of these numerical values, variations are allowed within the range where the above advantages can be obtained.

INDUSTRIAL APPLICABILITY

The present invention can provide a plasma display device and a driving method for a panel that are capable of enhancing the image display quality by enhancing the brightness of the display image while unformizing the display luminance, even with a panel having a large screen and high definition. Thus, the present invention is useful as a plasma display device and a driving method for a panel.

REFERENCE SIGNS LIST

1 Plasma display device
10 Panel (plasma display panel)
21 Front plate
22 Scan electrode
23 Sustain electrode
24 Display electrode pair
25, 33 Dielectric layer
26 Protective layer
31 Rear plate
32 Data electrode
34 Barrier rib
35 Phosphor layer
41 Image signal processing circuit
42 Data electrode driving circuit
43 Scan electrode driving circuit
44 Sustain electrode driving circuit
45 Timing generating circuit
60 Number of lit cells calculator
61 Load value calculator
62 Correction gain calculator
63 Data readout section
64 Discharge cell position determiner
68 Multiplier
69 Corrector
70 Loading correction part
101, 111, 112 Signal level
102, 113 Emission luminance
121, 131 Lighting state
122, 132 Calculated value

The invention claimed is:

1. A plasma display device comprising:

a plasma display panel, the plasma display panel being driven by a subfield method in which a plurality of subfields is set in one field, each of the subfields has an initializing period, an address period, and a sustain period, a luminance weight is set for each of the subfields, and sustain pulses corresponding in number to the luminance weight are generated in the sustain period for gradation display, the plasma display panel having a plurality of discharge cells, the discharge cells having display electrode pairs, each of the display electrode pairs being formed of a scan electrode and a sustain electrode; and an image signal processing circuit for converting an input image signal into image data showing light emission and no light emission in the discharge cells in each subfield, the image signal processing circuit including:

the number of lit cells calculator for calculating the number of discharge cells to be lit in each display electrode pair, in each subfield;

a load value calculator for calculating a load value of each of the discharge cells, according to the calculation result in the number of lit cells calculator;

a correction gain calculator for calculating a correction gain of each of the discharge cells, according to a position of the discharge cell and the calculation result in the load value calculator such that the correction gain is smaller in a central portion than in a peripheral portion on an image display surface of the plasma display panel, wherein the load value calculator and the correction gain calculator calculate the correction gain by:

setting a lighting state of each of the discharge cells in each of the subfields such that lighting is 1 and non-lighting is 0;

multiplying the calculation result in the number of lit cells calculator, the luminance weight set for corresponding one of the subfields, and the lighting state in one of the discharge cells of which correction gain is to be calculated, and calculating a total sum of the multiplication results in the respective subfields as the load value;

multiplying the number of discharge cells formed on the display electrode pair, the luminance weight set for corresponding one of the subfields, and the lighting state in the discharge cell of which correction gain is to be calculated, and calculating a total sum of the multiplication results in the respective subfields as a maximum load value; and subtracting the load value from the maximum load value, and dividing the subtraction result by the maximum load value; and a corrector for subtracting a multiplication result of output from the correction gain calculator and the input image signal, from the input image signal.

2. A driving method for a plasma display panel, the plasma display panel having a plurality of discharge cells, the discharge cells having display electrode pairs, each of the display electrode pairs being formed of a scan electrode and a sustain electrode, the plasma display panel being driven by a subfield method in which a plurality of subfields is set in one field, each of the subfields has an initializing period, an address period, and a sustain period, a luminance weight is set for each of the subfields, and sustain pulses corresponding in number to the luminance weight are generated in the sustain period for gradation display, the driving method comprising:

calculating the number of discharge cells to be lit in each display electrode pair, in each subfield;

calculating a load value of each of the discharge cells according to the number of discharge cells to be lit, and calculating a correction gain of each of the discharge cells according to a position of the discharge cell and the load value such that the correction gain is smaller in a central portion than in a peripheral portion on an image display surface of the plasma display panel, wherein the correction gain is calculated by:

setting a lighting state of each of the discharge cells in each of the subfields such that lighting is 1 and non-lighting is 0;

multiplying the calculation result in the number of lit cells calculator, the luminance weight set for corresponding one of the subfields, and the lighting state in one of the discharge cells of which correction gain is to be calculated, and calculating a total sum of the multiplication results in the respective subfields as the load value;

multiplying the number of discharge cells formed on the display electrode pair, the luminance weight set for corresponding one of the subfields, and the lighting state in the discharge cell of which correction gain is to be calculated, and calculating a total sum of the multiplication results in the respective subfields as a maximum load value; and subtracting the load value from the maximum load value, and dividing the subtraction result by the maximum load value; and multiplying the correction gain and an input image signal, and subtracting the multiplication result from the input image signal.

* * * * *